US011006682B2

(12) United States Patent
Li et al.

(10) Patent No.: US 11,006,682 B2
(45) Date of Patent: May 18, 2021

(54) GLOVE

(71) Applicant: SHANGHAI JIN FENG YU GLOVE CO., LTD., Shanghai (CN)

(72) Inventors: Qing Feng Li, Shanghai (CN); Wen-Lan Cai, Shanghai (CN); Haisheng Mo, Shanghai (CN); Ning Li, Shanghai (CN); Zhibin Li, Shanghai (CN)

(73) Assignee: Shanghai Jin Feng Yu Glove Co., Ltd., Shanghai (CN)

( * ) Notice: Subject to any disclaimer, the term of this patent is extended or adjusted under 35 U.S.C. 154(b) by 175 days.

(21) Appl. No.: 16/410,155

(22) Filed: May 13, 2019

(65) Prior Publication Data

US 2019/0261708 A1 Aug. 29, 2019

Related U.S. Application Data

(63) Continuation-in-part of application No. 15/035,939, filed as application No. PCT/CN2014/090528 on Nov. 7, 2014, now Pat. No. 10,342,273.

(30) Foreign Application Priority Data

Nov. 12, 2013 (CN) ..... 201310560492.5
Nov. 12, 2013 (CN) ..... 201310560501.0
Nov. 12, 2013 (CN) ..... 201310560503.X
Nov. 12, 2013 (CN) ..... 201310561245.7
Nov. 12, 2013 (CN) ..... 201320711864.5
Nov. 12, 2013 (CN) ..... 201320711865.X
Nov. 12, 2013 (CN) ..... 201320712624.7

(Continued)

(51) Int. Cl.
*A41D 19/00* (2006.01)

(52) U.S. Cl.
CPC ..... *A41D 19/001* (2013.01); *A41D 19/0006* (2013.01); *A41D 2300/52* (2013.01); *A41D 2500/10* (2013.01)

(58) Field of Classification Search
CPC ..... A41D 19/001; A41D 19/0006; A41D 2300/52; A41D 2500/10
See application file for complete search history.

(56) References Cited

U.S. PATENT DOCUMENTS 5,251,335 A * 10/1993 DeFusco ..... A63B 71/146 2/161.2
6,658,669 B1 * 12/2003 Addington ..... A63B 71/148 2/16

(Continued)

*Primary Examiner* — Tajash D Patel
(74) *Attorney, Agent, or Firm* — Rosenberg, Klein & Lee

(57) ABSTRACT

A glove has a glove core and a glove component. The glove core has a palm portion, a dorsum portion, a side portion of hand and a finger portion; the palm portion and the finger portion are connected to each other via a connection point, the finger piece portion has a first and second bonding portions with a distance therebetween, the finger piece portion is bound to the finger portion via the first bonding portion, and the finger piece portion is bound to the palm portion via the second bonding portion. The connection point, the first bonding portion and the second bonding portion are formed to have a virtual triangle, thus the finger portion and the palm portion have an angle being less than 180 degrees, and that is, the finger portion bends forward the palm portion to make the glove comply with the ergonomic principle.

20 Claims, 22 Drawing Sheets

(30) Foreign Application Priority Data

| | | |
|---|---|---|
| Nov. 12, 2013 | (CN) | 201320712636.X |
| May 28, 2014 | (CN) | 201410230373.8 |
| May 28, 2014 | (CN) | 201420278506.4 |
| Nov. 4, 2014 | (CN) | 201420653787.7 |

(56) References Cited

U.S. PATENT DOCUMENTS

| | | | | |
|---|---|---|---|---|
| 6,928,658 | B2 * | 8/2005 | Taira | A41D 13/0587 2/161.6 |
| 8,490,217 | B2 * | 7/2013 | Safford | A41D 19/01523 2/161.6 |
| 2005/0268374 | A1 * | 12/2005 | Mattesky | A41D 19/01547 2/164 |
| 2011/0296582 | A1 * | 12/2011 | Bevier | A63B 71/143 2/161.1 |
| 2013/0007937 | A1 * | 1/2013 | Stone | A41D 13/081 2/16 |
| 2013/0263356 | A1 * | 10/2013 | Jones | A41D 19/0017 2/163 |
| 2014/0059739 | A1 * | 3/2014 | Gellis | A41D 19/01547 2/168 |
| 2014/0215685 | A1 * | 8/2014 | Bush | A63B 71/146 2/161.1 |
| 2015/0374052 | A1 * | 12/2015 | Pimentel de Oliveira | A41D 19/01558 2/161.6 |
| 2016/0029721 | A1 * | 2/2016 | Sheehy | A41D 19/015 2/16 |
| 2016/0037839 | A1 * | 2/2016 | Vandenbosch | A41D 19/0065 2/457 |
| 2020/0121479 | A1 * | 4/2020 | Thompson | A41D 19/0006 |

* cited by examiner

GLOVE

CROSS REFERENCE

The present invention is Continuation-In-Part of U.S. patent application Ser. No. 15/035,939, and claims priority of U.S. patent application Ser. No. 15/035,939 filed on 2016 May 11, CN Patent Application 201310560503.X filed on 2013 Nov. 12, CN Patent Application 201320712636.X filed on 2013 Nov. 12, CN Patent Application 201310560501.0 filed on 2013 Nov. 12, CN Patent Application 201320711865.X filed on 2013 Nov. 12, CN Patent Application 201310561245.7 filed on 2013 Nov. 12, CN Patent Application 201320711864.5 filed on 2013 Nov. 12, CN Patent Application 201310560492.5 filed on 2013 Nov. 12, CN Patent Application 201320712624.7 filed on 2013 Nov. 12, CN Patent Application 201420278506.4 filed on 2014 May 28, CN Patent Application 201410230373.8 filed on 2014 May 28, and CN Patent Application 201420653787.7 filed on 2014 Nov. 4, wherein all contents of the references which priorities are claimed by the present invention are included in the present invention, herein.

FIELD OF THE INVENTION

The present invention relates to a glove, and more particularly to a glove which is simple in structure and can be formed easily, and a finger portion of the glove bends forward a palm portion of the glove when no forces are applied to the glove, such that the glove complies with the ergonomic principle.

BACKGROUND OF THE INVENTION

An existing glove is generally divided into a cloth glove, a plastic glove and an asbestos glove. Regarding the ergonomic principle, when the hand of the human is in a working mode (for example, holding an object) or in a general mode which no forces are applied, fingers of the hand bend forward a palm of the hand, and the fingers and the palm have an non-planar angle (less than 180 degrees). As disclosed by JP Pub. 2003-171815, a finger portion of a general glove and a palm portion of the general glove render a plane when no forces are applied to the general glove, and the glove does not comply with the hand shape of the ergonomic principle. The general glove causes the user to feel uncomfortable when the user wears the general glove, since the general glove does not comply with the ergonomic principle.

SUMMARY OF THE INVENTION

The present invention provides a glove which is simple in structure and can be formed easily, and a finger portion of the glove bends forward a palm portion of the glove when no forces are applied to the glove, such that the glove complies with the ergonomic principle.

To achieve at least one of objectives of the present invention, a glove having a glove core and a glove component is provided. The glove core has a palm portion, a dorsum portion, a side portion of hand and a finger portion, the palm portion and the finger portion are connected to each other via a connection point, and the finger portion further comprises a finger surface portion; the glove component comprises a finger piece portion, the finger piece portion has a first bonding portion and a second bonding portion, the first bonding portion and the second bonding portion have a distance therebetween, the finger piece portion is bound to the finger portion via the first bonding portion, and the finger piece portion is bound to the palm portion via the second bonding portion; wherein along the finger piece portion, the first bonding portion and the second bonding portion are formed with a first virtual line therebetween, a length of the first virtual line is denoted as a first virtual line length; the first bonding portion and the connection point are formed with a second virtual line therebetween, a length of the second virtual line is denoted as a second virtual line length; the second bonding portion and the connection point are formed with a third virtual line therebetween, a length of the third virtual line is denoted as a third virtual line length; a summation of the second virtual line length and the third virtual line length is larger than the first virtual line length.

To achieve at least one of objectives of the present invention, a glove having a glove core and a glove component is provided. The glove core has a palm portion, a dorsum portion, a side portion of hand and a finger portion, the finger portion further comprises a finger surface portion, a finger side portion, a finger back portion, a finger root portion and a fingertip portion. The glove component comprises a half-palm portion and a finger piece portion, both of them are independent to each other; the finger piece portion comprises a finger piece tip end, a finger piece side portion and a finger piece root end, a front end of the half-palm portion and a tail end of the finger piece portion are bound to each other via a combination region, and the combination region is disposed on the front end of the half-palm portion; wherein a distance between the finger root portion and the fingertip portion is denoted as a finger portion length, a distance between the finger piece tip end and the finger piece root end is denoted as a finger piece portion length, the finger piece portion length is less than or equal to the finger portion length.

To achieve at least one of objectives of the present invention, a glove having a glove core and a glove component is provided, the glove core is a knitting glove core, the glove core has a palm portion, a dorsum portion, a side portion of hand and multiple finger portions, and the palm portion, the dorsum portion, the side portion of hand and the finger portions are one-piece-formed, each of the finger portions further comprises a finger surface portion, a finger side portion, a finger back portion, a finger root portion and a fingertip portion; the glove component comprises a half-palm portion and finger piece portions being independent to half-palm portion; each of the finger piece portions comprises a finger piece tip end, a finger piece side portion and a finger piece root end; a front end of the half-palm portion has an adhesive layer, the half-palm portion is adhered to the palm portion via the first adhesive layer to cover at least one portion of the palm portion; a bottom surface of each of the finger piece portions has a second adhesive layer, each of the finger piece portions is adhered to the corresponding finger surface portion via the second adhesive layer to coven at least one portion of the finger surface portion; a front end of each of the finger piece portion is adhered to a front end of the corresponding finger surface portion via the second adhesive layer, a front end of the half-palm portion and a tail end of each of the finger piece portion are bound and overlapped to each other via a combination region, each of the combination regions is disposed on the front end of the half-palm portion; wherein a distance between each of the finger root portions and the fingertip portion is denoted as a finger portion length, and a distance between the finger piece tip end of the finger piece portion and the corresponding finger piece root end is denoted as a finger piece portion length, each of the finger piece portion lengths is less than or equal to the finger portion length; stiffness of the glove component and stiffness of each of the finger piece portions are larger than stiffness of the glove core; and the second adhesive layer of each of the finger piece portions seeps and fills in gaps of fibers of the corresponding finger surface portion and is bound to the fibers.

DESCRIPTION OF THE PREFERRED EMBODIMENTS

Figure 1A:
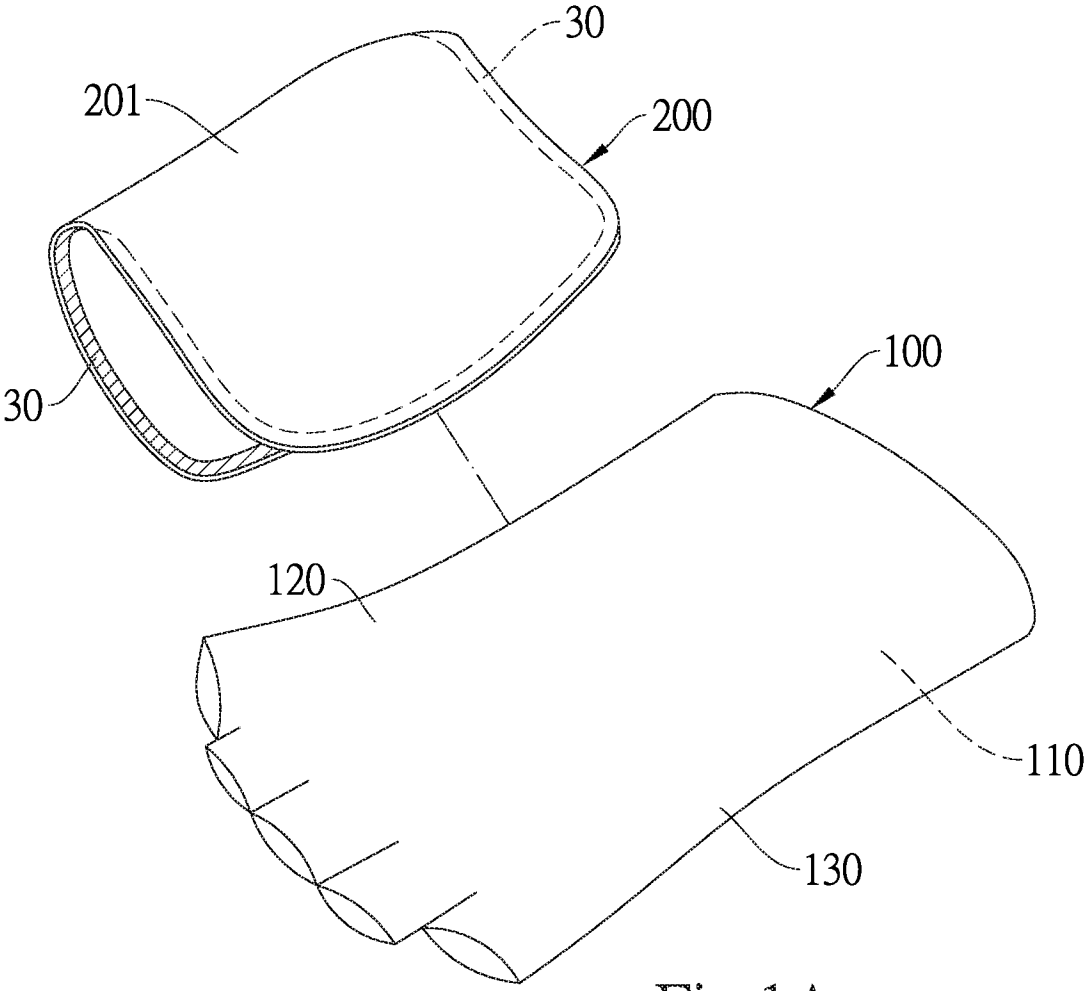
FIG. 1A is a schematic structure diagram showing separation of a glove core and a glove component in accordance with a first embodiment of the present invention.
Figure 1B:
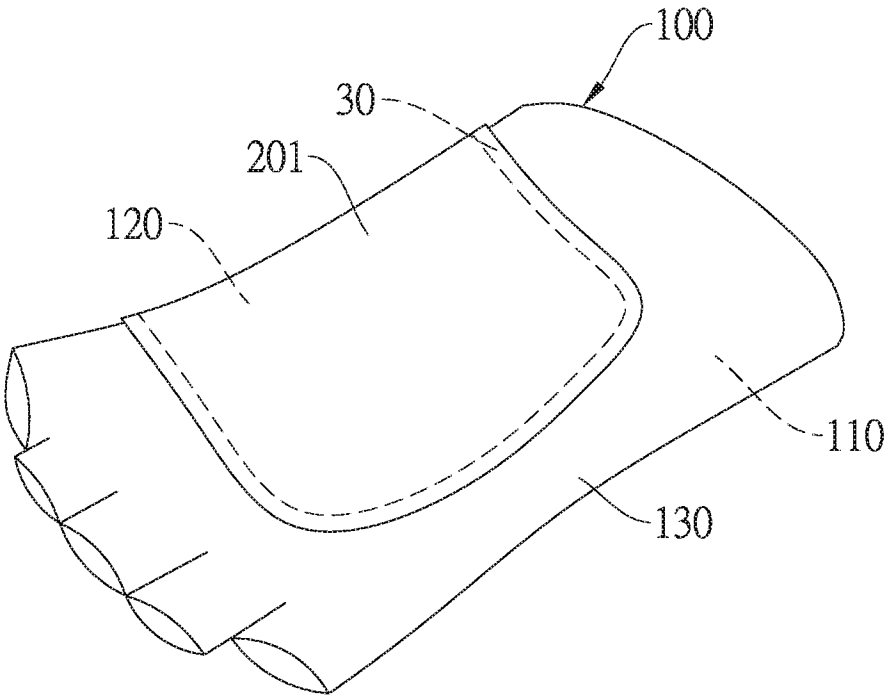
FIG. 1B is a schematic structure diagram showing combination of a glove core and a glove component in accordance with a first embodiment of the present invention.

A structure of a glove provided by a first embodiment of the invention is shown in FIG. 1A and FIG. 1B, the glove of the invention comprises a glove core 100 and at least one glove component 200, and the glove core 100 at least comprises a palm portion 110, a dorsum portion 120 and a side portion of hand 130. The glove core 100 is an object having a glove shape, for example, the glove core 100 can be a knitting glove core, a leather glove core made of leather, a plastic glove core made of plastic and a sewing glove core, wherein the knitting glove core can be the knitting glove core with 6, 7, 8, 9, 10, 11, 12, 13, 14, 15, 16, 17, 18 or 19 stitches.

The glove component 200 is an object which covers the glove core 100. For example, the glove component 200 can be made of fabric, no-woven fabric, plastic, rubber, polyvinylchloride (PVC), anti-leather, fiber artificial leather, pig head layer skin, pig split leather, pig suede, cow head layer skin, cow split leather, cow suede, sheep head layer skin, sheep suede, horse skin or buckskin. As shown in the drawings, the glove component 200 comprises a half-palm portion 201.

A bottom surface of the half-palm portion 201 of the glove component 200 is stitched to an outer surface of the glove core 100 via the stitching line, or alternatively, a bottom surface of the half-palm portion 201 of the glove component 200 is adhered to an outer surface of the glove core 100. The half-palm portion 201 of the glove component 200 covers at least one portion of the palm portion 110 of the glove core 100 and at least one portion of the dorsum portion 120 of the glove core 100. The adhesive manner can be to dispose at least one adhesive layer 30 merely on edges of the half-palm portion 201, the adhesive layer 30 can be made of polyurethane (PU), acrylate or other adhesive material, and can be an adhesive film or brush glue which is attached to the edges of the half-palm portion 201. The adhesive layer 30 is used to fix and adhere the half-palm portion 201 and the glove core 100. Of course, a high frequency or compression manner can be also used to achieve the fixing and adhering objective. The edges of the half-palm portion 201 are regions which have distances with 0 mm through 5 mm to terminal surfaces of the half-palm portion 201.

Figure 2:
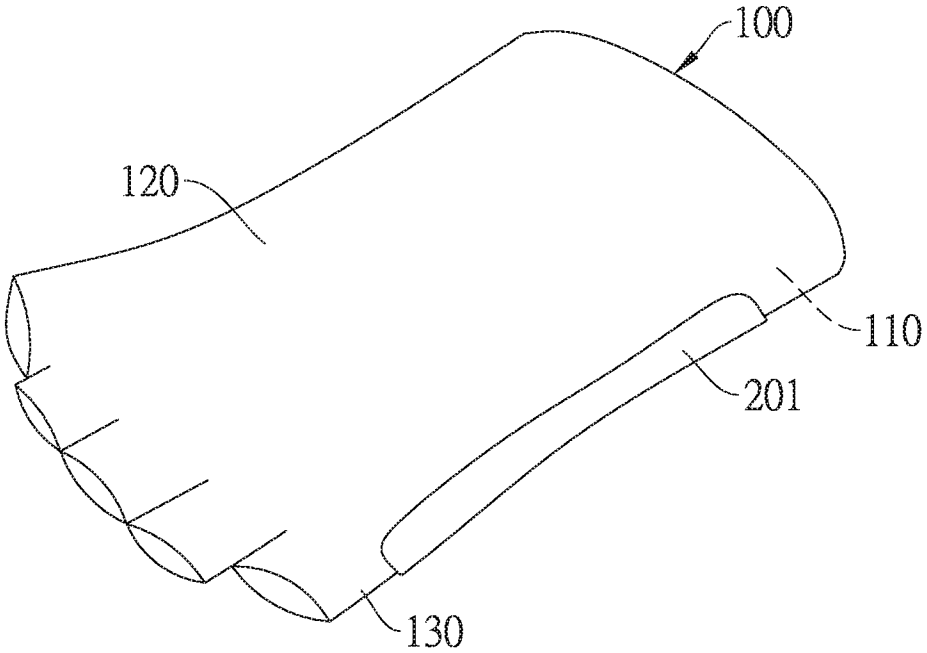
FIG. 2 is a schematic structure diagram showing a glove in accordance with a second embodiment of the present invention.
Figure 3:
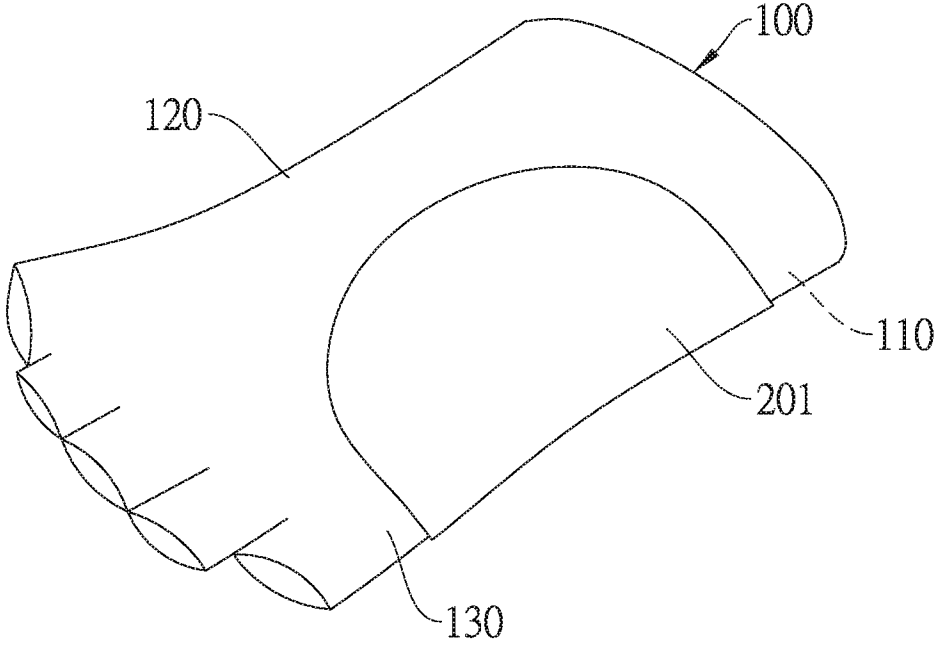
FIG. 3 is a schematic structure diagram showing a glove in accordance with a third embodiment of the present invention.

As shown by a second embodiment of FIG. 2, the half-palm portion 201 of the glove component 200 covers at least one portion of the palm portion 110 of the glove core 100 and at least one portion of the side portion of hand 130 of the glove core 100; or alternatively, as shown by a third embodiment of FIG. 3, the half-palm portion 201 of the glove component 200 covers at least one portion of the dorsum portion 120 of the glove core 100 and at least one portion of the side portion 130 of hand of the glove core 100.

Figure 4A:
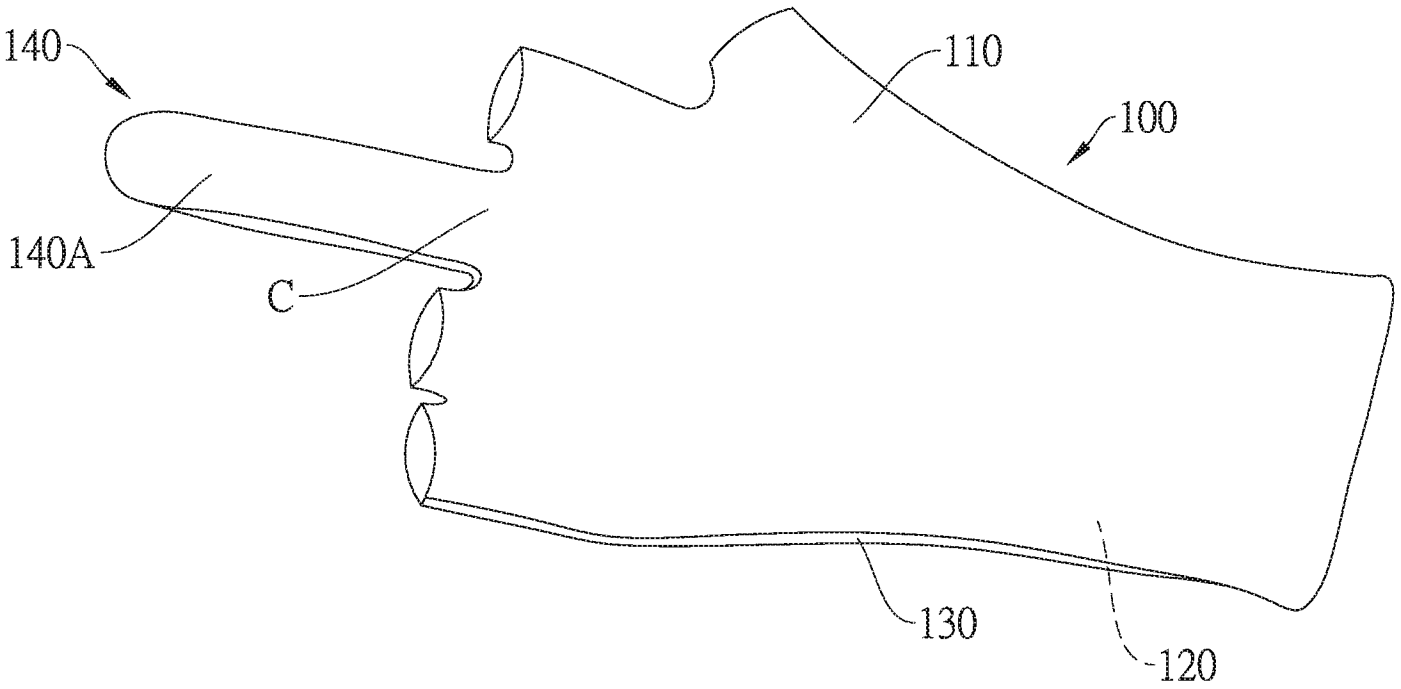
FIG. 4A is a schematic structure diagram showing a glove core in accordance with a fourth embodiment of the present invention.
Figure 4B:
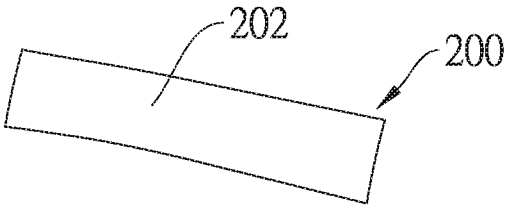
FIG. 4B is a schematic structure diagram showing a glove component in accordance with a fourth embodiment of the present invention.
Figure 4C:
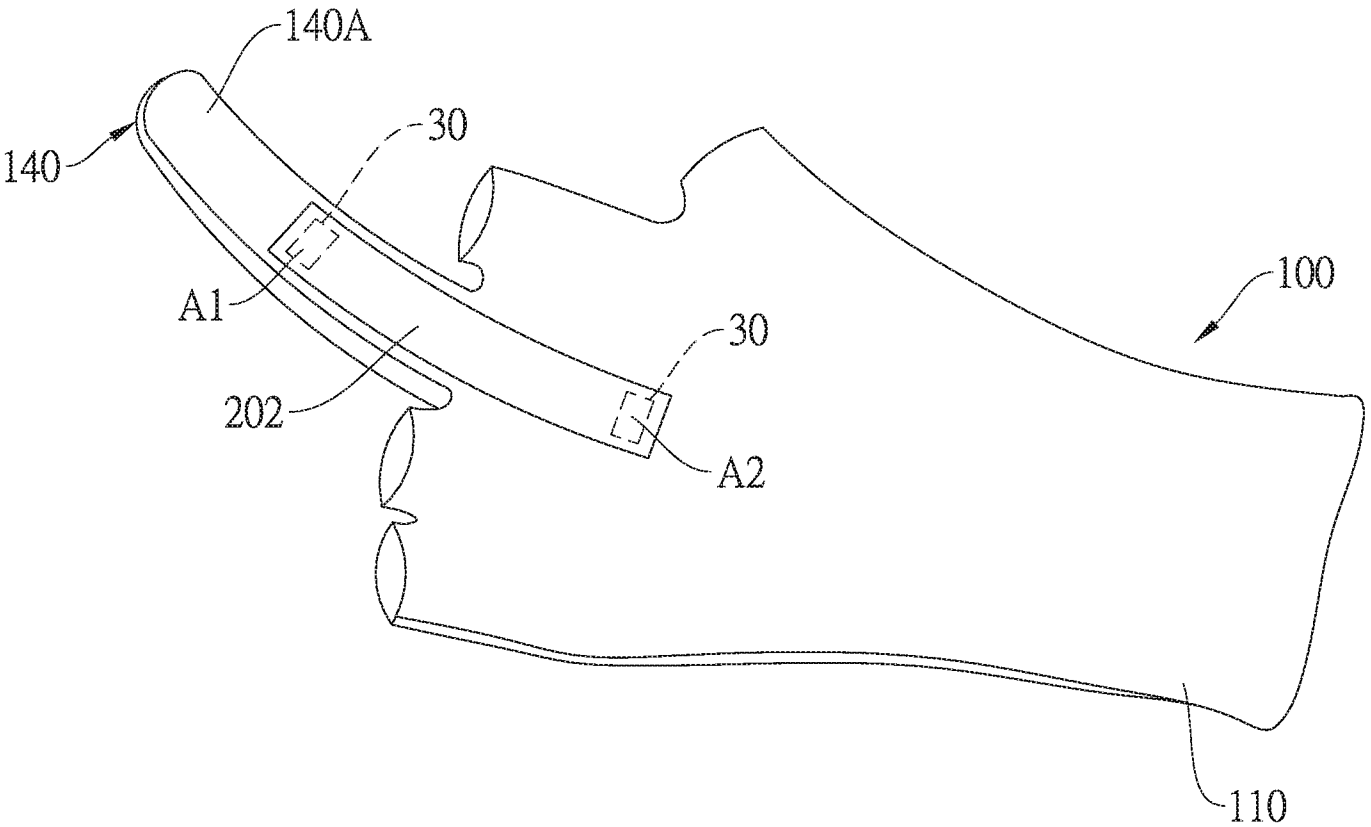
FIG. 4C is a first schematic structure diagram showing combination of a glove core and a glove component in accordance with a fourth embodiment of the present invention.
Figure 4D:
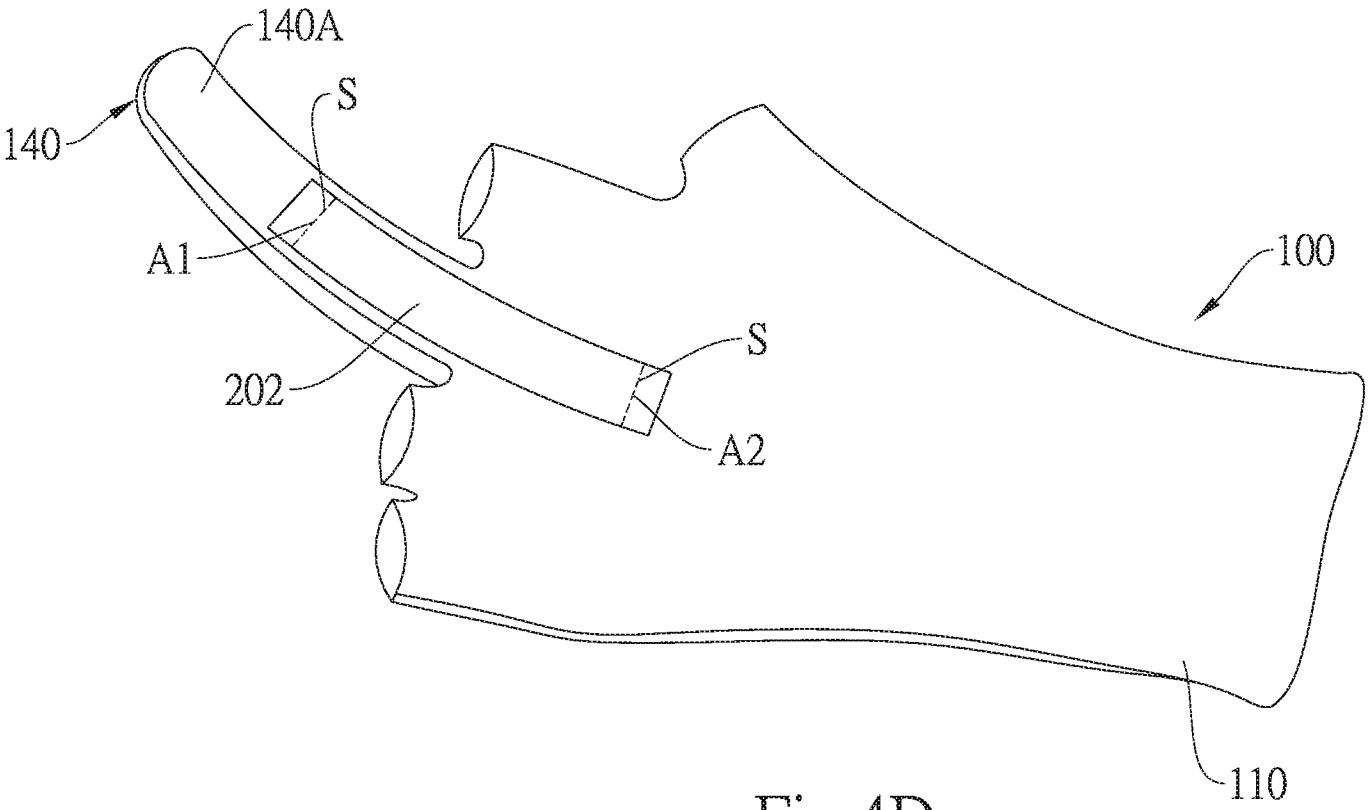
FIG. 4D is a second schematic structure diagram showing combination of a glove core and a glove component in accordance with a fourth embodiment of the present invention.

As shown in a fourth embodiment of FIG. 4A, the glove core 100 can further comprises the palm portion 110, the dorsum portion 120, the side portion 130 of hand and a finger portion 140, the palm portion 110 and the finger portion 140 are bound to each other via a connection point C, and the finger portion 140 further comprises a finger surface portion 140A. As shown in the fourth embodiment of FIG. 4B, the glove component 200 comprises a finger piece portion 202. As shown in the fourth embodiment of FIG. 4C, the finger piece portion 202 has a first bonding portion A1 and a second bonding portion A2, the first bonding portion A1 and the second bonding portion A2 have a distance therebetween, the finger piece portion 202 is bound to the finger portion 140 via the first bonding portion A1, and the finger piece portion 202 is bound to the palm portion 110 via the second bonding portion A2. Preferably, the finger piece portion 202 is bound to the finger surface portion 140A of the finger surface portion 140A via the first bonding portion A1. The above bonding manner can be to dispose the adhesive layer 30 on the bottom surface of the first bonding portion A1 and the bottom surface of the second bonding portion A2, and thus, the first bonding portion A1 of finger piece portion 202 can be adhered to the finger portion 140 via the adhesive layer 30, or the second bonding portion A2 of the finger piece portion 202 is adhered to the palm portion 110 via the adhesive layer 30. Of course, a high frequency or compression manner can be also used to achieve the fixing and adhering objective, such that the finger piece portion 202 can be bound to the finger portion 140 via the first bonding portion A1, and the finger piece portion 202 is bound to the palm portion 110 via the second bonding portion A2. As shown in the fourth embodiment of FIG. 4D, the combination manner can also be to stitch the first bonding portion A1 of the finger piece portion 202 to the finger portion 140 via stitching lines S, and to stitch the second bonding portion A2 of the finger piece portion 202 to the palm portion 110.

Figure 4E:
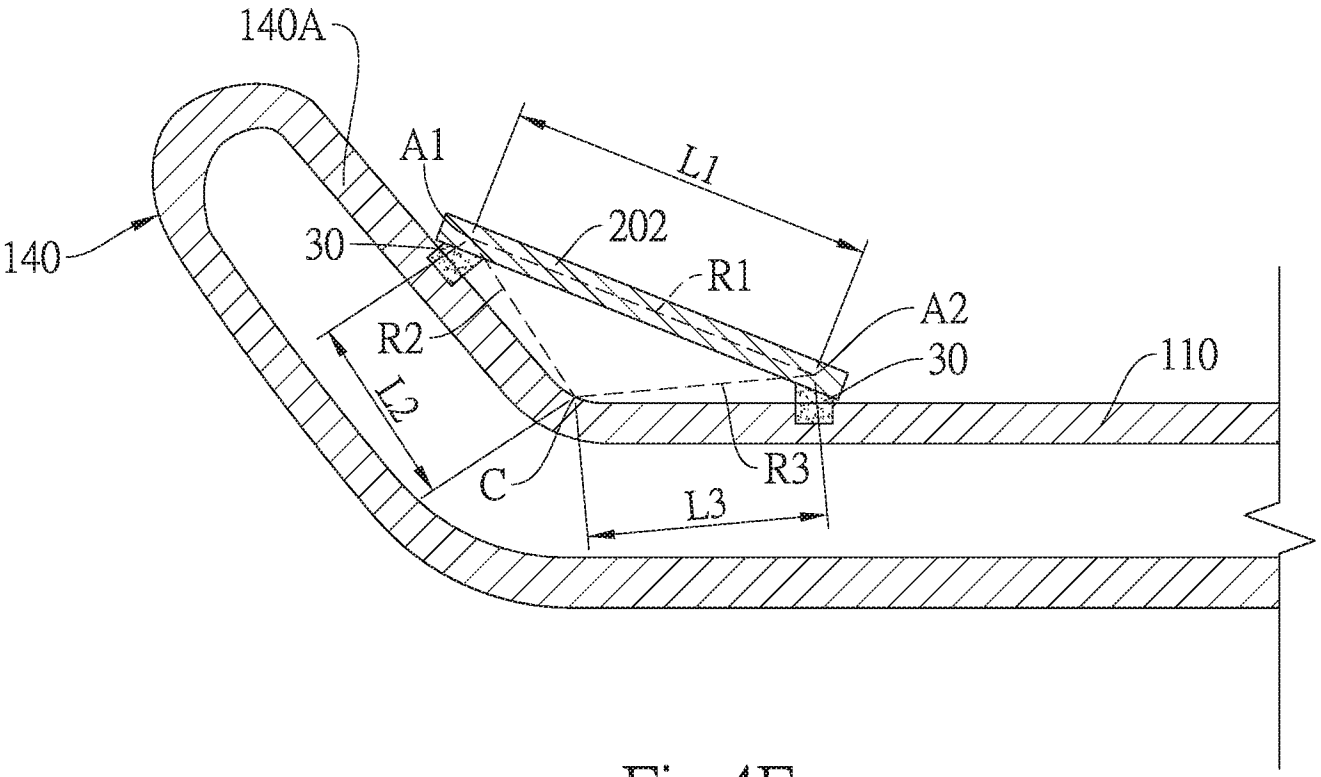
FIG. 4E is a first structure diagram showing a sectional view of combination of a glove core and a glove component in accordance with a fourth embodiment of the present invention.

As shown in the fourth embodiment of FIG. 4E, along the finger piece portion 202, the first bonding portion A1 and the second bonding portion A2 are formed with a first virtual line R1 therebetween, a length of the first virtual line R1 is denoted as a first virtual line length L1; the first bonding portion A1 and the connection point C are formed with a second virtual line R2 therebetween, a length of the second virtual line R2 is denoted as a second virtual line length L2; the second bonding portion A2 and the connection point C are formed with a third virtual line R3 therebetween, a length of the third virtual line R3 is denoted as a third virtual line length L3; and a summation of the second virtual line length L2 and the third virtual line length L3 is larger than the first virtual line length L1. Since the connection point C, the first bonding portion A1 and the second bonding portion A2 are formed with a virtual triangle, the finger portion 140 and the palm portion 110 has a non-planar angle (less than 180 degrees), and that is, the finger portion 140 bends forward the palm portion 110 to form the glove complying with the ergonomic principle.

Figure 4F:
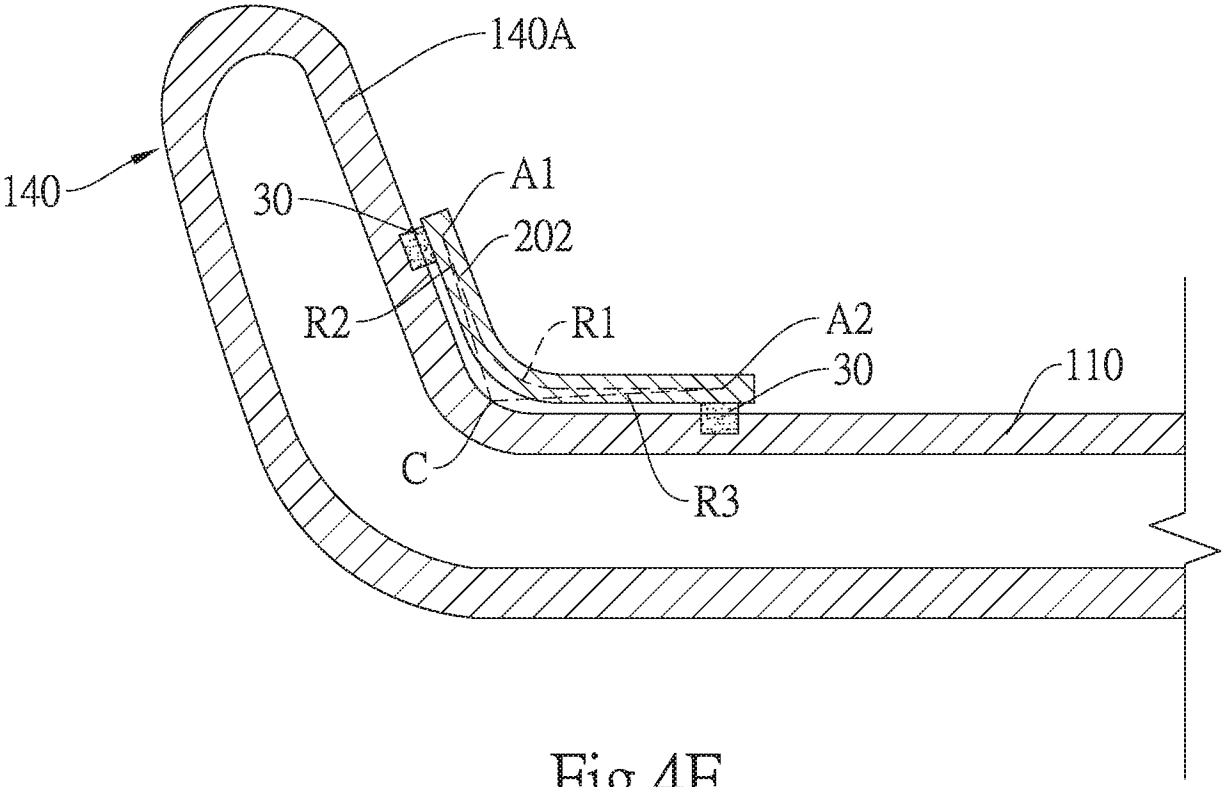
FIG. 4F is a third structure diagram showing a sectional view of combination of a glove core and a glove component in accordance with a fourth embodiment of the present invention.

It is noted that, the first virtual line R1 can be a straight line, a non-straight line or a curve line. For example, as shown in the fourth embodiment of FIG. 4E, the first virtual line R1, the second virtual line R2 and the third virtual line R3 are straight lines. For example, as shown in the fourth embodiment of FIG. 4F, the second virtual line R2 and the third virtual line R3 are straight lines and the first virtual line R1 is a non-straight line, the first virtual line length L1 is a distance counted along the finger piece portion 202, from the first bonding portion A1 to the second bonding portion A2. In other words, the first virtual line length L1 is a length of the non-straight line.

Figure 5A:
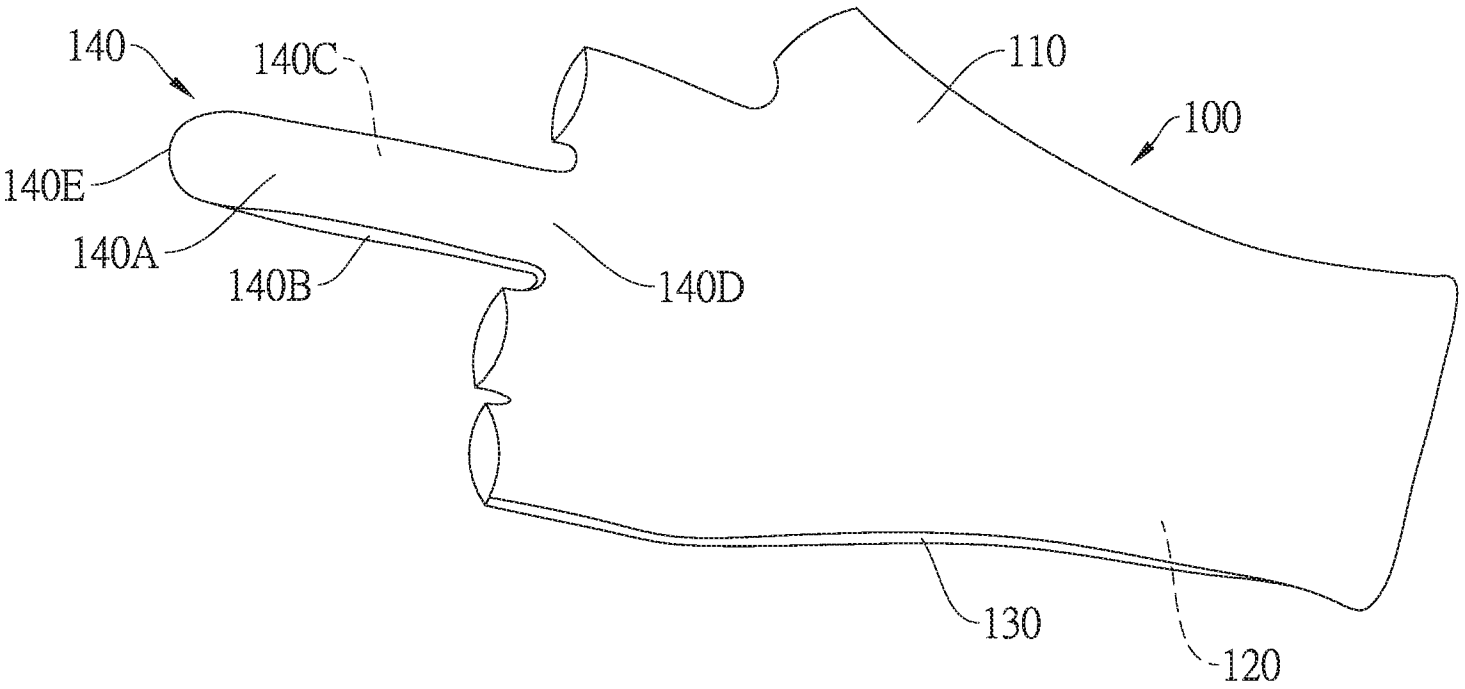
FIG. 5A is a schematic structure diagram showing a glove core in accordance with a fifth embodiment of the present invention.

As shown in the fifth embodiment of FIG. 5A, the glove core 100 has the palm portion 110, the dorsum portion 120, the side portion 130 of hand and at least one finger portion 140, the finger portion 140 further comprises a finger surface portion 140A, a finger side portion 140B, a finger back portion 140C, a finger root portion 140D and a fingertip portion 140E, wherein a distance between the finger root portion 140D and the fingertip portion 140E is denoted as a finger portion length. It is noted that, preferably, the glove core 100 is a knitting glove core, and the palm portion 110, the dorsum portion 120, the side portion 130 of hand and the finger portion 140 are one-piece-formed (i.e. an integrally knit structure). Since the glove core 100 is the knitting glove core, the glove core 100 has extensibility and compressibility in all directions, which is beneficial to the processing of subsequent processes, and the glove core 100 is soft and comfortable to wear.

Figure 5B:
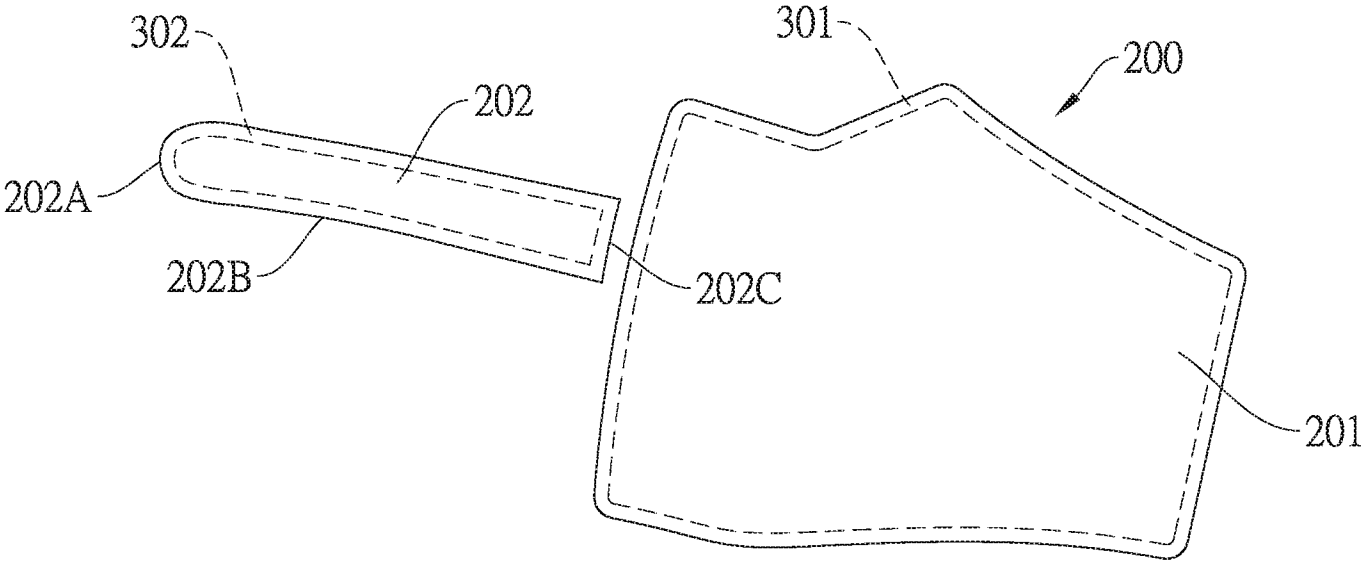
FIG. 5B is a schematic structure diagram showing a glove component in accordance with a fifth embodiment of the present invention.

As shown in the fifth embodiment of FIG. 5B, the glove component 200 comprises a half-palm portion 201 and at least one finger piece portion 202, and both of them are independent to each other. The finger piece portion 202 comprises a finger piece tip end 202A, a finger piece side portion 202B and a finger piece root end 202C, wherein a distance between the finger piece tip end 202A and the finger piece root end 202C is denoted as a finger piece portion length. The finger piece portion length is less than or equal to the finger portion length. A bottom surface of the half-palm portion 201 has a first adhesive layer 301; preferrably, merely edges of the bottom surface of the half-palm portion 201 are disposed with the first adhesive layer 301; and more preferably, the first adhesive layer 301 merely surrounds whole edges of the bottom surface of the half-palm portion 201. A bottom surface of the finger piece portion 202 has a second adhesive layer 302; preferably, merely edges of the bottom surface of the finger piece portion 202 are disposed with the second adhesive layer 302; and more preferably, the second adhesive layer 302 merely surrounds whole edges of the bottom surface of the finger piece portion 202. The edges of the bottom surface of the finger piece portion 202 are regions which have distances with 0 mm through 5 mm to terminal surfaces of the finger piece portion 202; and the edges of the half-palm portion 201 are regions which have distances with 0 mm through 5 mm to terminal surfaces of the half-palm portion 201.

Figure 5C:
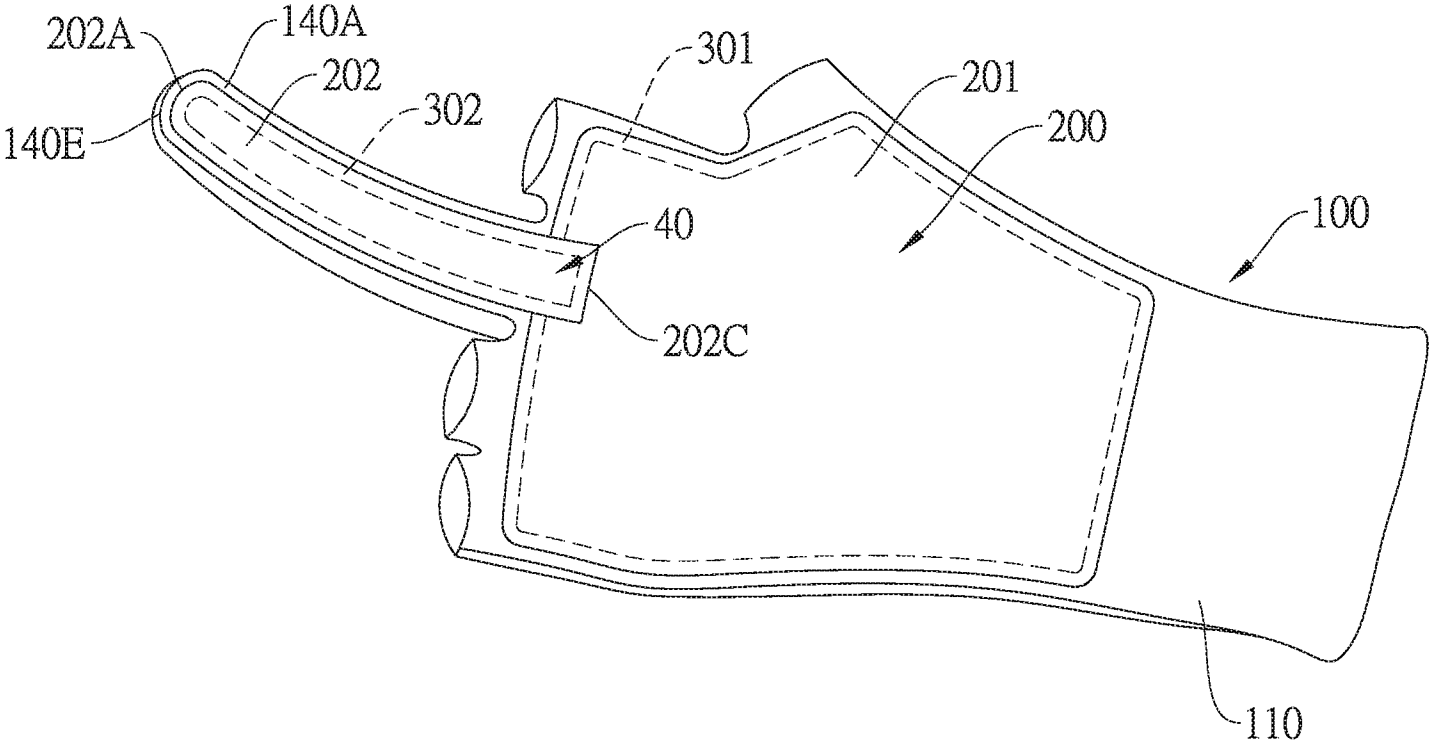
FIG. 5C is a first schematic structure diagram showing combination of a glove core and a glove component in accordance with a fifth embodiment of the present invention.

As shown in the fifth embodiment of FIG. 5C, the glove of the invention has the glove core 100 and the glove component 200. The half-palm portion 201 is bound to the palm portion 110 by using the first adhesive layer 301 to cover at least one portion of the palm portion 110, and the finger piece portion 202 is bound to the finger surface portion 140A by using the second adhesive layer 302 to cover at least one portion of the finger surface portion 140A. The front end of the half-palm portion 201 and the tail end of the finger piece portion 202 are adhered and overlapped to each other by using the combination region 40, so as to form the glove component 200. For example, the front end of the half-palm portion 201 and the finger piece root end 202C of the tail end of the finger piece portion 202 are adhered and overlapped to each other by using the combination region 40, so as to form the glove component 200. A width of the combination region 40 is 1 mm through 15 mm, and preferably, 2 mm through 5 mm. It is noted that, preferably, the front end of the finger piece portion 202 is bound to the front end of the finger surface portion 140A via the second adhesive layer 302, the front end of the half-palm portion 201 is bound and overlapped to the tail end of the finger piece portion 202 via the combination region 40, and the tail end of the finger piece portion 202 is bound to the top surface of the front end of the half-palm portion 201 via the combination region 40. When implementing, the half-palm portion 201 is adhered to the palm portion 110 by using the first adhesive layer 301, then, the finger piece tip end 202A is adhered to the fingertip portion 140E, and next, the tail end of the finger piece portion 202 is adhered to the top surface of the front end of the of the half-palm portion 201 via the second adhesive layer 302 to form the combination region 40. Thus, the formed combination region 40 is disposed on the front end of the half-palm portion 201. Meanwhile, since the finger piece portion length is less than or equal to the finger portion length, the finger portion 140 bends forward the palm portion 110 to make the glove comply with the ergonomic principle.

Figure 5D:
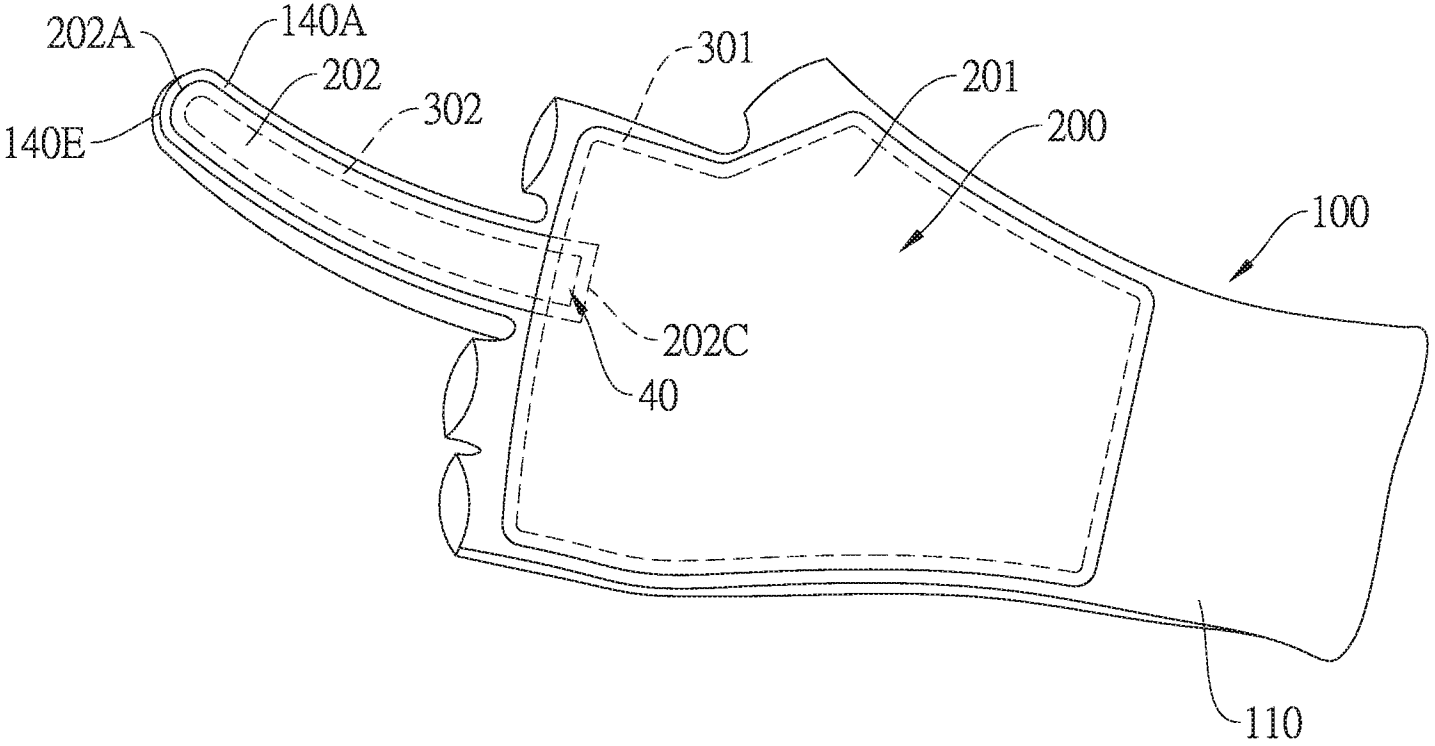
FIG. 5D is a second schematic structure diagram showing combination of a glove core and a glove component in accordance with a fifth embodiment of the present invention.
Figure 5E:
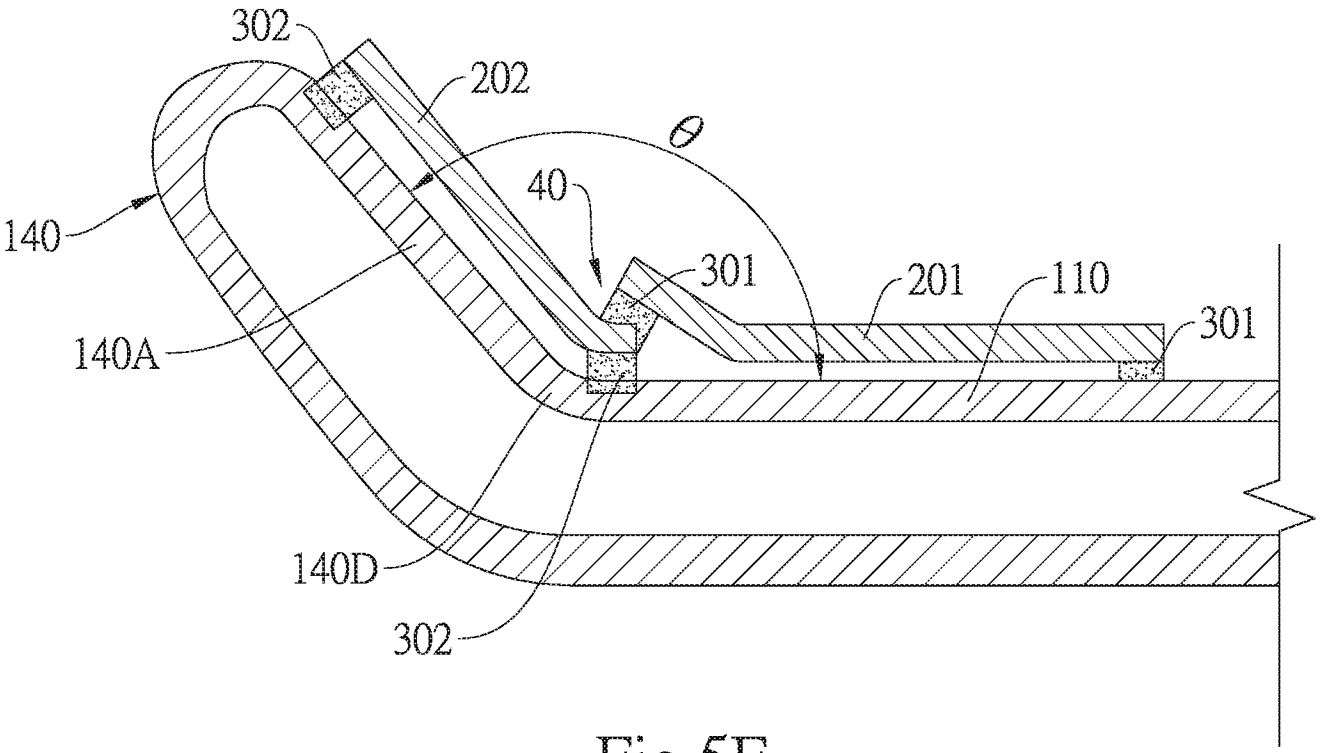
FIG. 5E is a second structure diagram showing a sectional view of combination of a glove core and a glove component in accordance with a fifth embodiment of the present invention.

As shown in the fifth embodiment of FIG. 5D and FIG. 5E, preferably, the front end of the finger piece portion 202 is adhered to the front end of the finger surface portion 140A via the second adhesive layer 302, the front end of the half-palm portion 201 is bound and overlapped to the tail end of the finger piece portion 202 via the combination region 40, the front end of the half-palm portion 201 is adhered to the top surface of the tail end of the finger piece portion 202 via the combination region 40. When implementing, the finger piece tip end 202A is adhered to the fingertip portion 140E via the second adhesive layer 302, then, the tail end of the finger piece portion 202 is adhered to the palm portion 110 via the second adhesive layer 302, and next, the front end of the half-palm portion 201 is adhered to the top surface of the tail end of the finger piece portion 202 via the first adhesive layer 301 to form the combination region 40. Thus, the formed combination region 40 is disposed on the front end of the half-palm portion 201. Similarly, since the since the finger piece portion length is less than or equal to the finger portion length, the finger portion 140 bends forward the palm portion 110, the finger portion 140 and the palm portion 110 have an angle θ being less than 180 degrees, and this makes the glove comply with the ergonomic principle.

It is noted that, of course, the combination region 40 can be located at the intersection (i.e. the finger root portion 140D) of the finger portion 140 and the half-palm portion 201.

It is noted that, stiffness of the glove component 200 must be larger than that of to glove core 100. In other words, stiffness of the half-palm portion 201 and stiffness of the finger piece portion 202 are larger than stiffness of the glove core 100. The stiffness is measured in accordance with ASTM D1388-96(Reapproved 2002), Option A—Cantilever Test. Since the stiffness of the finger piece portion 202 is larger than that of the glove core 100, and the finger piece portion length is less than or equal to the finger portion length, this makes the finger portion 140 bend forward the palm portion 110 easier, and the ergonomic principle can be easily met. Of course, the stiffness of the half-palm portion 201 and the stiffness of the finger piece portion 202 can be identical or different, and the stiffness of the half-palm portion 201 and the stiffness of the finger piece portion 202 are larger than that of the glove core 100. Preferably, the stiffness of the finger piece portion 202 is larger than that of the half-palm portion 201, and the stiffness of the half-palm portion 201 is larger than that of the glove core 100.

The first adhesive layer 301 and the second adhesive layer 302 are made of polyurethane (PU), acrylate or other adhesive material, and can be an adhesive films or brush glues which are attached to the edges of the half-palm portion 201 and the edges of the finger piece portion 202. The first adhesive layer 301 is used to adhere and fix the half-palm portion 201 and the palm portion 110, and the second adhesive layer 302 is used to adhere and fix the finger piece portion 202 and the finger surface portion 140A. Of course, the high frequency and compression manner be also used to achieve the bonding and fixing objective. As shown in the fifth embodiment of FIG. 5E, the second adhesive layer 302 seeps and fills to the interior of the finger piece portion 202. For example, the second adhesive layer 302 seeps and fills in gaps of fibers of the finger surface portion 140A and is bound to the fibers. Thus, it increases the stiffness of the finger portion 140, and helps the finger portion 140 to bend forward the palm portion 110.

Figure 5F:
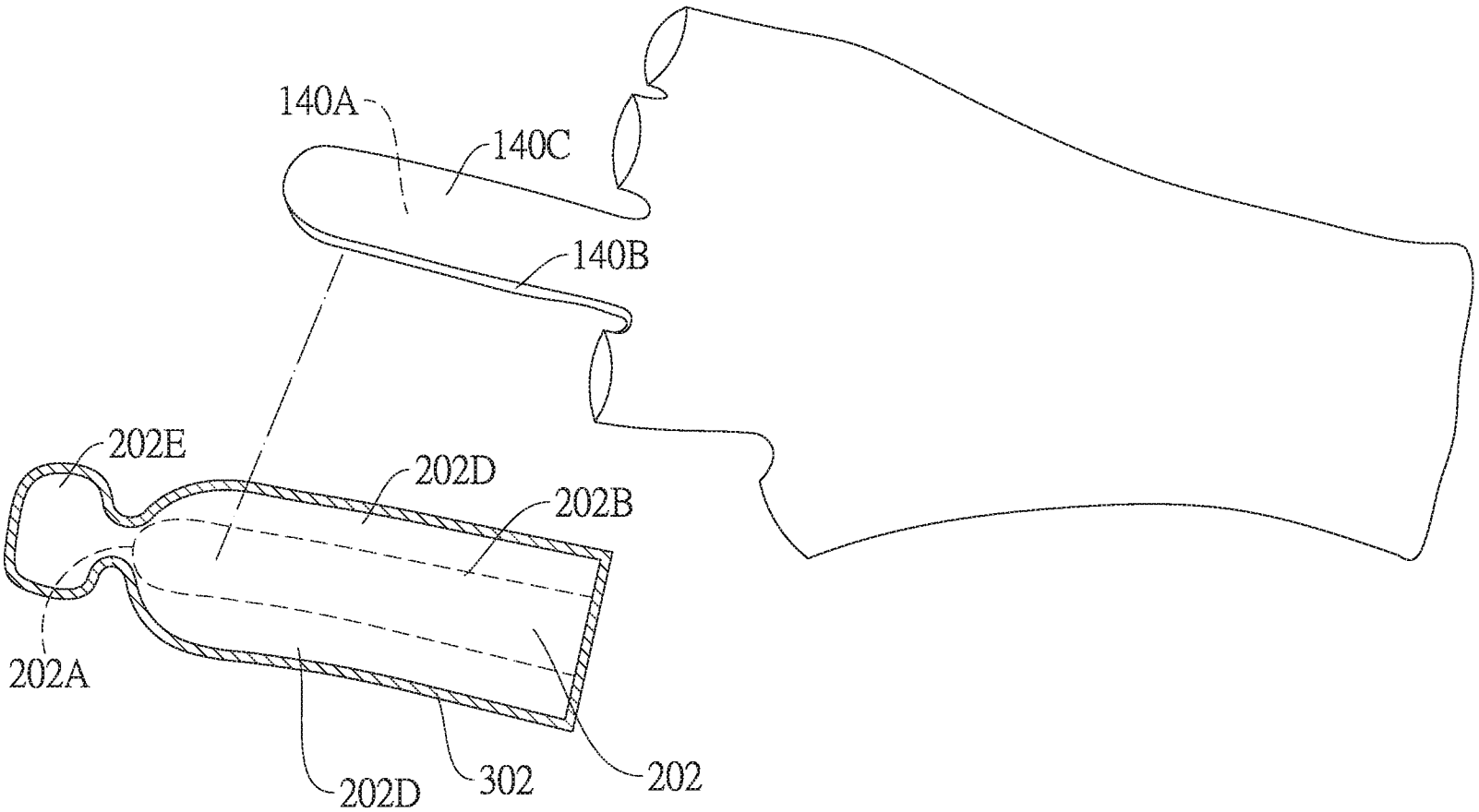
FIG. 5F is a schematic structure diagram showing separation of a glove core and a glove component in accordance with a first embodiment of the present invention.
Figure 5G:
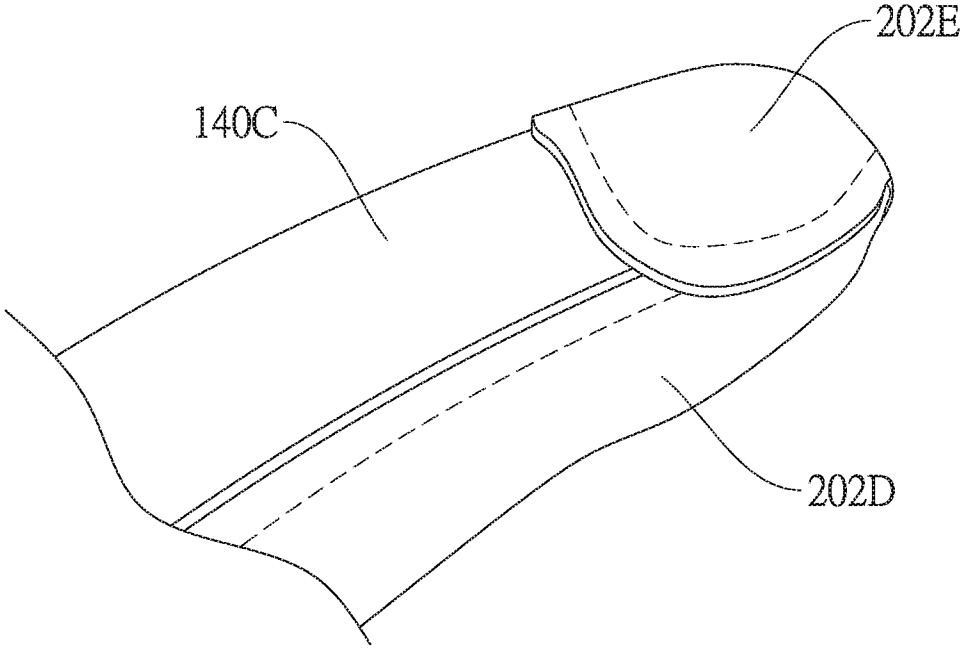
FIG. 5G is a schematic structure diagram showing combination of a finger piece portion and a finger portion in accordance with a fifth embodiment of the present invention.

As shown in the fifth embodiment of FIG. 5F and FIG. 5G, the finger piece portion 202 is bound to at least one portion of the finger surface portion 140A, at least one portion of the finger side portion 140B and at least one portion of the finger back portion 140C, by using the second adhesive layer 302. For example, the finger piece portion 202 further comprises a wing portion 202D laterally extended from the finger piece side portion 202B, the wing portion 202D and the finger piece side portion 202B are one-piece-formed, and the wing portion 202D is adhered to at least one portion of the finger side portion 140B and to at least one portion of the finger back portion 140C via the second adhesive layer 302. Further, the finger piece portion 202 further comprises a protruding portion 202E vertically extended from the finger piece tip end 202A, the protruding portion 202E and the finger piece tip end 202A are one-piece-formed, and the protruding portion 202E is adhered to at least one portion of the fingertip portion 140E and to at least one portion of the finger back portion 140C via the second adhesive layer 302. Preferably, the protruding portion 202E is adhered to at least one portion of the wing portion 202D via the second adhesive layer 302, or the wing portion 202D is adhered to at least one portion of protruding portion 202E via the second adhesive layer 302.

Figure 6A:
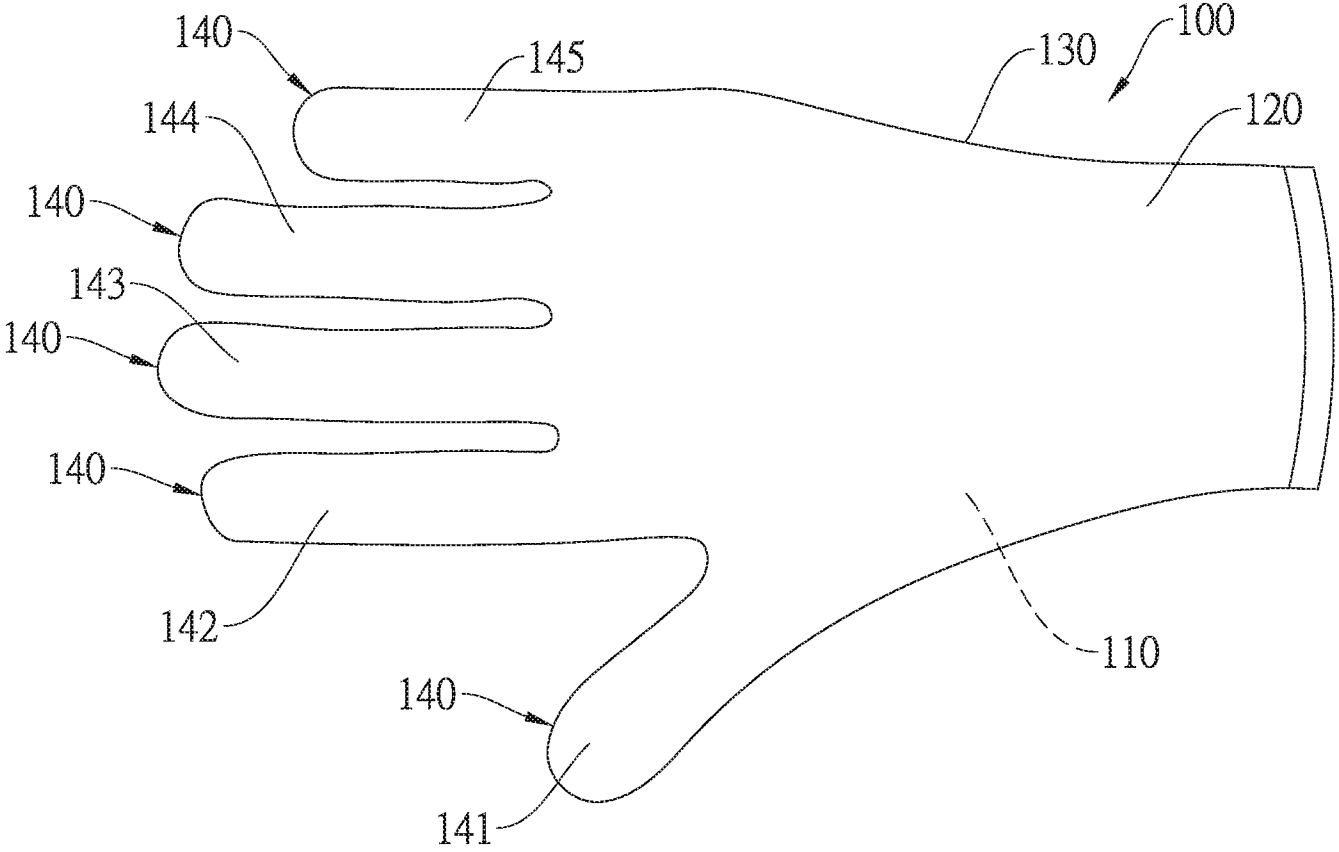
FIG. 6A is a schematic structure diagram showing a glove core in accordance with a sixth embodiment of the present invention.
Figure 6B:
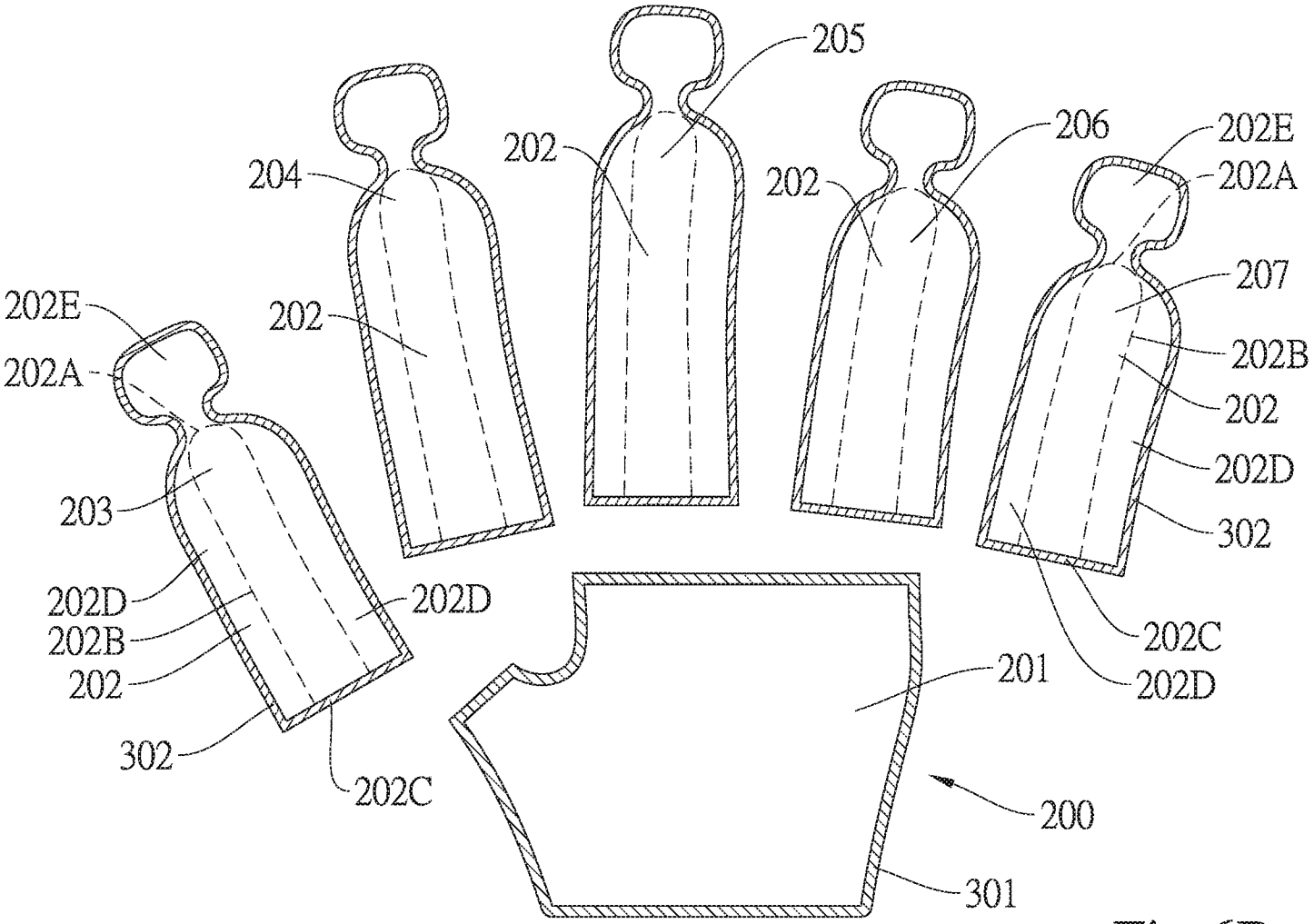
FIG. 6B is a schematic structure diagram showing a glove component in accordance with a sixth embodiment of the present invention.
Figure 6C:
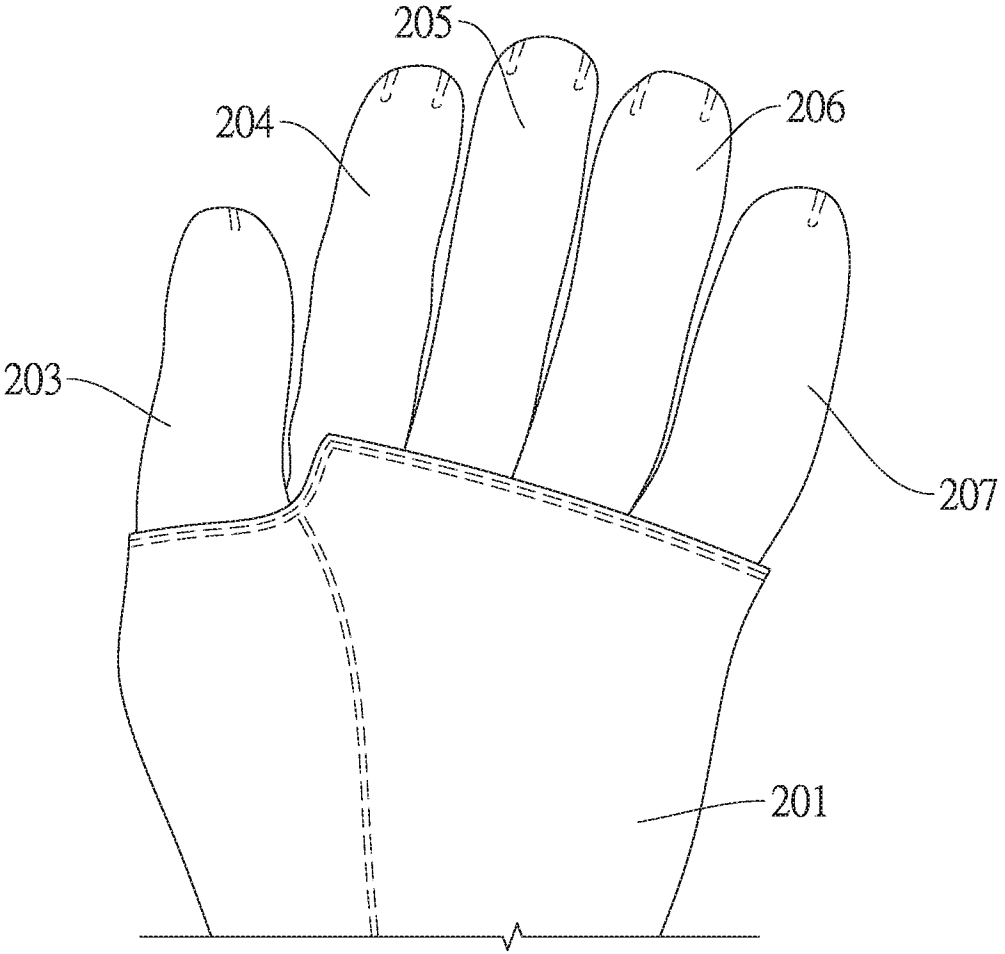
FIG. 6C is a schematic structure diagram showing a front view of a glove in accordance with a sixth embodiment of the present invention.
Figure 6D:
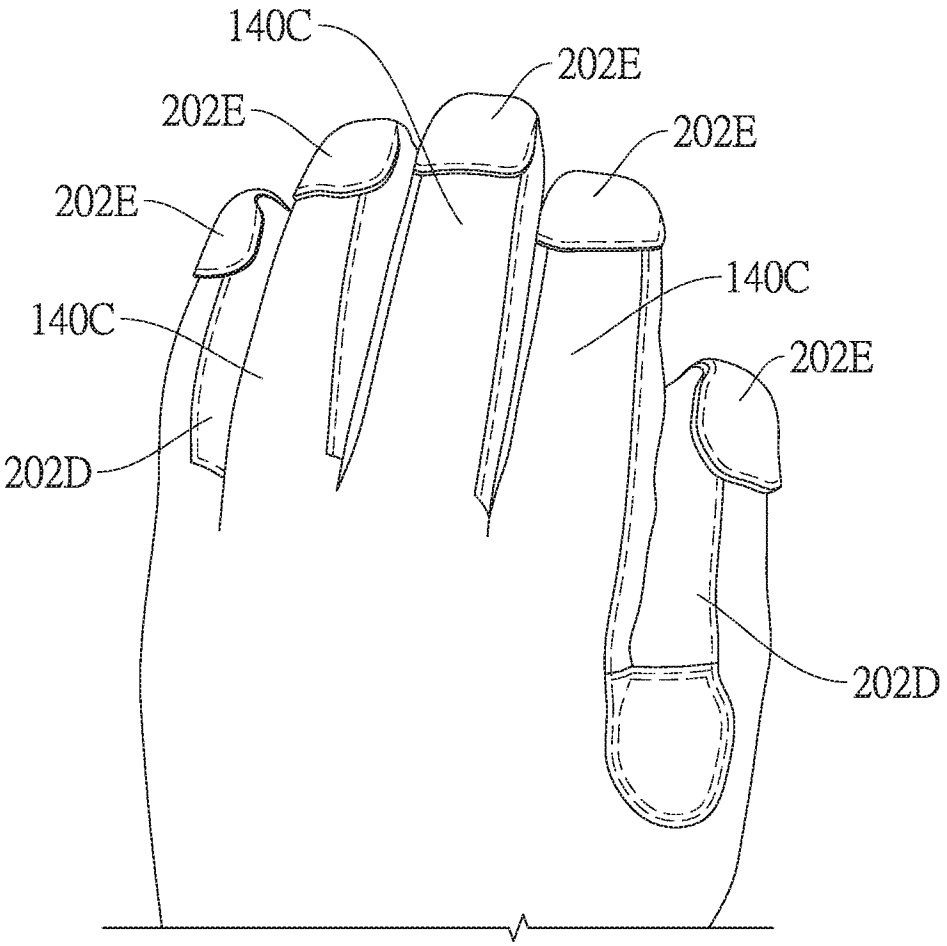
FIG. 6D is a schematic structure diagram showing a rear view of a glove in accordance with a sixth embodiment of the present invention.
Figure 6E:
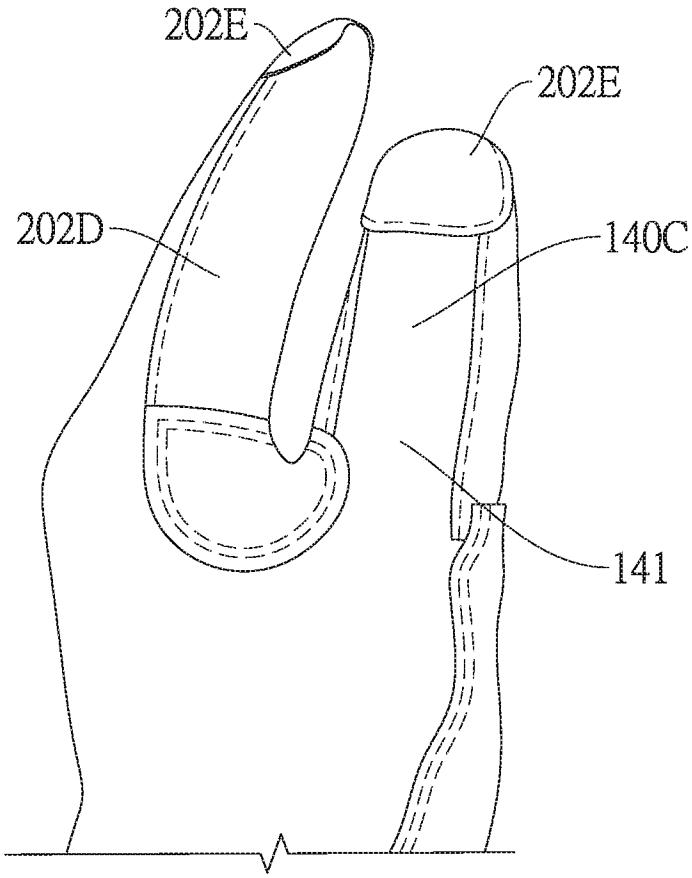
FIG. 6E is a schematic structure diagram showing a side view of a glove in accordance with a sixth embodiment of the present invention.

Next, the sixth embodiment is induced from the above fifth embodiment, and the similar features are not repeatedly described. As shown in the sixth embodiment of FIG. 6A through FIG. 6E, wherein the glove in FIG. 6A and FIG. 6B is a glove for a right hand, the glove in FIG. 6C through FIG. 6E is a glove for a left hand, and both of the two gloves have a mirroring relation. The glove core 100 has a palm portion 110, a dorsum portion 120, a side portion 130 of hand and multiple finger portions 140, and the glove core 100 is a knitting glove core. The palm portion 110, the dorsum portion 120, the side portion 130 of hand and the finger portions 140 are one-piece-formed. Wach of the finger portions 140 further comprises a finger surface portion 140A, a finger side portion 140B, a finger back portion 140C, a finger root portion 140D and a fingertip portion 140E. The finger portions 140 are respectively a thumb sleeve 141, an index finger sleeve 142, a middle finger sleeve 143, a ring finger sleeve 144 and a little finger sleeve 145.

The glove component 200 comprises a half-palm portion 201 and finger piece portions 202 being independent to half-palm portion 201. A bottom surface of the half-palm portion 201 has a first adhesive layer 301, and the half-palm portion 201 is adhered to the palm portion 110 via the first adhesive layer 301 to cover at least one portion of the palm portion 110. Each of the finger piece portions 202 comprises a finger piece tip end 202A, a finger piece side portion 202B and a finger piece root end 202C, a bottom surface of each of the finger piece portions 202 has a second adhesive layer 302, and each of the finger piece portions 202 is adhered to the corresponding finger surface portion 140A via the second adhesive layer 302 to coven at least one portion of the finger surface portion 140A. A front end of each of the finger piece portion 202 is adhered to a front end of the corresponding finger surface portion 140A via the second adhesive layer 302, a front end of the half-palm portion 201 and a tail end of each of the finger piece portion 202 are bound and overlapped to each other via a combination region 40, and each of the combination regions 40 is disposed on the front end of the half-palm portion 201. The finger piece portions 202 are respectively a thumb piece 203, an index finger piece 204, a middle finger piece 205, a ring finger piece 206 and a little finger piece 207, and all of them are independent to each other.

It is noted that, the thumb piece 203, the index finger piece 204, the middle finger piece 205, the ring finger piece 206 and the little finger piece 207 of the finger piece portion 202 are respectively corresponding to the thumb sleeve 141, the index finger sleeve 142, the middle finger sleeve 143, the ring finger sleeve 144 and the little finger sleeve 145 of the finger portions 140.

A distance between each of the finger root portions 140D and the fingertip portion 140E is denoted as a finger portion length, and a distance between the finger piece tip end 202A of the finger piece portion 202 and the corresponding finger piece root end 202C is denoted as a finger piece portion length, and each of the finger piece portion lengths is less than or equal to the finger portion length. Stiffness of the glove component 200 and stiffness of each of the finger piece portions 202 are larger than stiffness of the glove core 100, and the second adhesive layer 302 of each of the finger piece portions seeps and fills in gaps of fibers of the corresponding finger surface portion 140A and is bound to the fibers. Thus, each of the finger portions 140 bends forward the palm portion 110, each of the finger portion 140 and the palm portion has an angle θ being less than 180 degrees, and the ergonomic principle can be met.

Each of the combination regions 40 is formed by a top surface of the front end of the half-palm portion 201 which is adhered to the tail end of the corresponding finger piece portion 202 via the corresponding second adhesive layer 302, or the combination region 40 is formed by a top surface of the tail end of the corresponding finger piece portion 202 which is adhered to the front end of the half-palm portion 201 via the first adhesive layer 301.

The first adhesive layer 301 merely surrounds whole edges of the bottom surface of the half-palm portion 201, each of the second adhesive layers 302 merely surrounds whole edges of the bottom surface of the corresponding finger piece portion 202.

Each of the finger piece portion 202 further comprises a wing portion 202D laterally extended from the corresponding finger piece side portion 202B, the wing portion 202D and the corresponding finger piece side portion 202B are one-piece-formed, and the wing portion 202D is adhered to at least one portion of the corresponding finger side portion 140B and to at least one portion of the corresponding finger back portion 140C via the second adhesive layer 302.

Each of the finger piece portions 202 further comprises a protruding portion 202E vertically extended from the corresponding finger piece tip end 202A, the protruding portion 202E and the corresponding finger piece tip end 202A are one-piece-formed, and the protruding portion 202E is adhered to at least one portion of the corresponding fingertip portion 140E and to at least one portion of the corresponding finger back portion 140C via the second adhesive layer 302. The protruding portion 202E is adhered to at least one portion of the wing portion 202D via the second adhesive layer 302, or the wing portion 202D is adhered to at least one portion of the protruding portion 202E via the second adhesive layer 302.

In the fifth and sixth embodiments, since the finger piece portion length is less than or equal to the finger portion length, the front end of the finger piece portion 202 is adhered to the front end of the finger surface portion 140A via the second adhesive layer 302, front end of the half-palm portion 201 and the tail end of the finger piece portion 202 are bound and overlapped to each other via the combination region 40, the combination region 40 is disposed on the front end of the half-palm portion 201, the stiffness of the half-palm portion 201 and the stiffness of the finger piece portion 202 are larger than that of the glove core 100, and the second adhesive layer 302 seeps and fills the fibers of the finger surface portion 140A and is bound to the fibers, each of the finger portions 140 bends forward the palm portion 110, each of the finger portion 140 and the palm portion has an angle θ being less than 180 degrees, and the ergonomic principle can be met.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A glove, having a glove core and a glove component; wherein, the glove core has a palm portion, a dorsum portion, a side portion of hand and a finger portion, the palm portion and the finger portion are connected to each other via a connection point, the finger portion further comprises a finger surface portion;

the glove component comprises a bounding piece portion, the bounding piece portion has a first bonding portion and a second bonding portion, and the first bonding portion and the second bonding portion have a distance therebetween, the first bonding portion of the bounding piece portion is bound to the finger portion, and the second bonding portion of the bounding piece portion is bound to the palm portion;

wherein along the bounding piece portion, the first bonding portion and the second bonding portion are formed with a first virtual line therebetween, a length of the first virtual line is denoted as a first virtual line length; the first bonding portion and the connection point are formed with a second virtual line therebetween, a length of the second virtual line is denoted as a second virtual line length; the second bonding portion and the connection point are formed with a third virtual line therebetween, a length of the third virtual line is denoted as a third virtual line length; a summation of the second virtual line length and the third virtual line length is larger than the first virtual line length.

2. The glove according to claim 1, wherein a bottom surface of the first bonding portion and a bottom surface of the second bonding portion are disposed with an adhesive layer, the first bonding portion of the bounding piece portion is bound to the finger portion by using the adhesive layer, the second bonding portion of the bounding piece portion is bound to the palm portion by using the adhesive layer.

3. The glove according to claim 1, wherein the first bonding portion of the bounding piece portion is adhered to the finger portion by using a high frequency or compressing manner, the second bonding portion of the bounding piece portion is adhered to the palm portion by using the high frequency or compressing manner.

4. The glove according to claim 1, wherein a stitching line is used to stitch the first bonding portion of the bounding piece portion to the finger portion, and stitch the second bonding portion of the bounding piece portion to the palm portion.

5. The glove according to claim 1, wherein the first virtual line, the second virtual line and the third virtual line are straight lines.

6. The glove according to claim 1, wherein the second virtual line and the third virtual line are straight lines, the first virtual line is a non-straight line, the first virtual line length is a distance counted along the bounding piece portion from the first bonding portion to the second bonding portion.

7. A glove, having a glove core and a glove component; wherein, the glove core has a palm portion, a dorsum portion, a side portion of hand and a finger portion, the finger portion further comprises a finger surface portion, a finger side portion, a finger back portion, a finger root portion and a fingertip portion;

the glove component comprises a half-palm portion and a bounding piece portion, both of the half-palm portion and the bounding piece portion are independent to each other; the bounding piece portion comprises a finger piece tip end, a finger piece side portion and a finger piece root end, a front end of the half-palm portion and a tail end of the bounding piece portion are bound to each other via a combination region, and the combination region is disposed on the front end of the half-palm portion;

wherein a distance between the finger root portion and the fingertip portion is denoted as a finger portion length, a distance between the finger piece tip end and the finger piece root end is denoted as a bounding piece portion length, the bounding piece portion length is less than or equal to the finger portion length.

8. The glove according to claim 7, wherein the glove core is a knitting glove core.

9. The glove according to claim 7, wherein the palm portion, the dorsum portion, the side portion of hand and the finger portion are one-piece-formed.

10. The glove according to claim 7, wherein a bottom surface of the half-palm portion has a first adhesive layer, the half-palm portion is bound to the palm portion by using the first adhesive layer to cover at least one portion of the palm portion; a bottom surface of the bounding piece portion has a second adhesive layer, the bounding piece portion is bound to the finger surface portion by using the second adhesive layer to cover at least one portion of the finger surface portion; a front end of the bounding piece portion is bound to a front end of the finger surface portion by using the second adhesive layer, the front end of the half-palm portion and the tail end of the bounding piece portion are adhered and overlapped to each other by using the combination region; the combination region is formed by a top surface of the front end of the half-palm portion which is adhered to the tail end of the bounding piece portion via the second adhesive layer, or the combination region is formed by a top surface of the tail end of the bounding piece portion which is adhered to the front end of the half-palm portion via the first adhesive layer.

11. The glove according to claim 7, wherein stiffness of the half-palm portion and stiffness of the bounding piece portion are larger than stiffness of the glove core.

12. The glove according to claim 7, wherein the glove core is a knitting glove core, and the palm portion, the dorsum portion, the side portion of hand and the finger portion are one-piece-formed; a bottom surface of the half-palm portion has a first adhesive layer, the half-palm portion is bound to the palm portion by using the first adhesive layer to cover at least one portion of the palm portion; a bottom surface of the bounding piece portion has a second adhesive layer, the bounding piece portion is bound to the finger surface portion by using the second adhesive layer to cover at least one portion of the finger surface portion; a front end of the bounding piece portion is bound to a front end of the finger surface portion by using the second adhesive layer, the front end of the half-palm portion and the tail end of the bounding piece portion are adhered and overlapped to each other by using the combination region; the combination region is formed by a top surface of the front end of the half-palm portion which is adhered to the tail end of the bounding piece portion via the second adhesive layer, or the combination region is formed by a top surface of the tail end of the bounding piece portion which is adhered to the front end of the half-palm portion via the first adhesive layer; stiffness of the half-palm portion and stiffness of the bounding piece portion are larger than stiffness of the glove core; and the second adhesive layer seeps and fills in gaps of fibers of the finger surface portion and is bound to the fibers.

13. The glove according to claim 12, wherein the first adhesive layer merely surrounds whole edges of the bottom surface of the half-palm portion, the second adhesive layer merely surrounds whole edges of the bottom surface of the bounding piece portion.

14. The glove according to claim 13, wherein the bounding piece portion further comprises a wing portion laterally extended from the finger piece side portion, the wing portion and the finger piece side portion are one-piece-formed, the wing portion is adhered to at least one portion of the finger side portion and to at least one portion of the finger back portion via the second adhesive layer; the bounding piece portion further comprises a protruding portion vertically extended from the finger piece tip end, the protruding portion and the finger piece tip end are one-piece-formed, the protruding portion is adhered to at least one portion of the fingertip portion and to at least one portion of the finger back portion via the second adhesive layer; the protruding portion is adhered to at least one portion of the wing portion via the second adhesive layer, or the wing portion is adhered to at least one portion of the protruding portion via the second adhesive layer.

15. The glove according to claim 7, the finger portions bends forward the palm portion, and the finger portion and the palm portion has an angle being less than 180 degrees.

16. A glove, having a glove core and a glove component; wherein, the glove core is a knitting glove core, the glove core has a palm portion, a dorsum portion, a side portion of hand and multiple finger portions, and the palm portion, the dorsum portion, the side portion of hand and the finger portions are one-piece-formed, each of the finger portions further comprises a finger surface portion, a finger side portion, a finger back portion, a finger root portion and a fingertip portion;

the glove component comprises a half-palm portion and bounding piece portions being independent to half-palm portion; each of the bounding piece portions comprises a finger piece tip end, a finger piece side portion and a finger piece root end; a front end of the half-palm portion has an adhesive layer, the half-palm portion is adhered to the palm portion via the first adhesive layer to cover at least one portion of the palm portion; a bottom surface of each of the bounding piece portions has a second adhesive layer, each of the bounding piece portions is adhered to the corresponding finger surface portion via the second adhesive layer to cover at least one portion of the finger surface portion; a front end of each of the bounding piece portion is adhered to a front end of the corresponding finger surface portion via the second adhesive layer, a front end of the half-palm portion and a tail end of each of the bounding piece portion are bound and overlapped to each other via a combination region, each of the combination regions is disposed on the front end of the half-palm portion;

wherein a distance between each of the finger root portions and the fingertip portion is denoted as a finger portion length, and a distance between the finger piece tip end of the bounding piece portion and the corresponding finger piece root end is denoted as a bounding piece portion length, each of the bounding piece portion lengths is less than or equal to the finger portion length; stiffness of the glove component and stiffness of each of the bounding piece portions are larger than stiffness of the glove core; and the second adhesive layer of each of the bounding piece portions seeps and fills in gaps of fibers of the corresponding finger surface portion and is bound to the fibers.

17. The glove according to claim 16, wherein the first adhesive layer merely surrounds whole edges of the bottom surface of the half-palm portion, each of the second adhesive layers merely surrounds whole edges of the bottom surface of the corresponding bounding piece portion.

18. The glove according to claim 16, wherein each of the bounding piece portion further comprises a wing portion laterally extended from the corresponding finger piece side portion, the wing portion and the corresponding finger piece side portion are one-piece-formed, the wing portion is adhered to at least one portion of the corresponding finger side portion and to at least one portion of the corresponding finger back portion via the second adhesive layer; each of the bounding piece portions further comprises a protruding portion vertically extended from the corresponding finger piece tip end, the protruding portion and the corresponding finger piece tip end are one-piece-formed, the protruding portion is adhered to at least one portion of the corresponding fingertip portion and to at least one portion of the corresponding finger back portion via the second adhesive layer; the protruding portion is adhered to at least one portion of the wing portion via the second adhesive layer, or the wing portion is adhered to at least one portion of the protruding portion via the second adhesive layer.

19. The glove according to claim 18, wherein the finger portions are respectively a thumb sleeve, an index finger sleeve, a middle finger sleeve, a ring finger sleeve and a little finger sleeve, the bounding piece portions are respectively a thumb piece, an index finger piece, a middle finger piece, a ring finger piece and a little finger piece, all of them are independent to each other.

20. The glove according to claim 16, wherein each of the finger portions bends forward the palm portion, and each of the finger portion and the palm portion has an angle being less than 180 degrees.

* * * * *